US005308173A

United States Patent [19]

Amano et al.

[11] Patent Number: 5,308,173

[45] Date of Patent: May 3, 1994

[54] SELF-PROPELLED COMPOSITE PRINTING DEVICE FOR PRINTING EITHER ON A TAPE OR ON A FLAT SURFACE

[75] Inventors: Toshio Amano; Hisayoshi Fujimoto, both of Kyoto, Japan

[73] Assignee: Rohm Co., Ltd., Kyoto, Japan

[21] Appl. No.: 906,939

[22] Filed: Jun. 30, 1992

[30] Foreign Application Priority Data

Sep. 6, 1991 [JP] Japan ..... 3-71837[U]

[51] Int. Cl.[5] ..... B41J 3/28; B41J 11/48

[52] U.S. Cl. ..... 400/29; 400/88; 400/120; 400/193; 400/592

[58] Field of Search ..... 400/592, 88, 120, 193, 400/23, 29, 31

[56] References Cited

U.S. PATENT DOCUMENTS

| | | | |
|---|---|---|---|
| 4,962,430 | 10/1990 | Hiroki et al. | 400/88 |
| 4,999,016 | 3/1991 | Suzuki et al. | 400/88 |
| 5,002,410 | 3/1991 | Yajima | 400/88 |
| 5,020,928 | 6/1991 | Akiyama et al. | 400/120 |
| 5,024,541 | 6/1991 | Tsukada et al. | 400/88 |
| 5,028,934 | 7/1991 | Kasai et al. | 400/120 |
| 5,111,216 | 5/1992 | Richardson et al. | 400/88 |

FOREIGN PATENT DOCUMENTS

| | | |
|---|---|---|
| 63-94741 | 6/1988 | Japan . |
| 63-170236 | 11/1988 | Japan . |
| 63-191037 | 12/1988 | Japan . |
| 2-55670 | 4/1990 | Japan . |

*Primary Examiner*—Edgar S. Burr
*Assistant Examiner*—Lynn D. Hendrickson
*Attorney, Agent, or Firm*—William H. Eilberg

[57] ABSTRACT

A composite printing device comprises a portable printer and a tape printer case removably engageable with the portable printer from below. The portable printer includes a bottom printing head, a pair of drive wheels and a pair of idle wheels. The tape printer case accommodates a tape roll for supplying a tape, a platen for guiding the tape, and a feed roller for feeding the tape from the tape roll. When the tape printer case is engaged with the portable printer, the printing head faces the tape guided by the platen while the drive wheel is operatively connected to the feed roller for rotationally driving the feed roller.

10 Claims, 5 Drawing Sheets

SELF-PROPELLED COMPOSITE PRINTING DEVICE FOR PRINTING EITHER ON A TAPE OR ON A FLAT SURFACE

BACKGROUND OF THE INVENTION

1. Field of the Invention

This invention relates generally to printers. More specifically, the present invention relates to a composite printing device which is usable both as a tape printer and as a portable printer.

2. Description of the Prior Art

Tape printers and portable printers are both known. The tape printer is most commonly used at a cashier of a shop, hotel or restaurant for printing out the calculated amount on a relatively narrow paper tape. On the other hand, the portable printer is used to print out necessary information only at a specific portion or portions of a relatively wide paper sheet.

In general, the tape printer comprises a case which accommodates a roll of paper tape, a feed mechanism for feeding a tape from the tape roll, a printing head for printing information onto the tape, and a guide for forcing the tape against the printing head, as disclosed in Japanese Utility Model Application No. 2-55670 (Filed: Oct. 15, 1988; Laid-open: Apr. 23, 1990) for example. However, the tape printer is disadvantageous in that it is applicable only to a relatively narrow tape.

The portable printer typically comprises a case which carries a printing head such as a thermal head, a feed mechanism for feeding an ink ribbon in contact with the printing head, and wheels for movably supporting the case, as disclosed for example in Japanese Utility Model Applications No. 63-170236 (Filed: Apr. 25, 1987; Laid-open: Nov. 7, 1988), No. 63-191037 (Filed: May 23, 1997; Laid-open: Dec. 8, 1998), and No. 63-94741 (Filed: Dec. 11, 1986; Laid-open: Jun. 18, 1988). The wheels include at least one drive wheel for automatically running on a desk top for example in synchronous relation to the feed speed of the ink ribbon while printing information on a paper sheet spread on the desk top.

Obviously, the applicability of the portable printer is not limited by the paper size itself. However, it is very inconvenient for the portable printer to print information on a continuous narrow tape and then cut off the printed tape portion from the remainder. More importantly, since the wheels of the portable printer cannot engage the narrow tape, it is difficult to synchronize the running speed (corresponding to the tape feed speed) of the printer with the transfer speed of the ink ribbon due to slips of the wheels relative to the desk top for example.

Thus, the prior art tape printer and portable printers, which are designed for different purposes, have their own applications.

SUMMARY OF THE INVENTION

It is, therefore, an object of the present invention to provide a composite printing device which is capable of using both as a tape printer and as a portable printer.

Another object of the present invention is to utilize a single drive source for driving the tape printer and the portable printer.

A further object of the present invention is to utilize a single drive source for performing an automatic coating process in addition to driving the tape printer and the portable printer.

According to the present invention, there is provided a composite printing device comprising: a portable printer including a printing head having a downwardly facing printing portion, and a plurality of wheels for supporting the portable printer, at least one of the wheels being a drive wheel rotationally driven by a motor; and a tape printer case removably engageable with the portable printer from below, the tape printer case accommodating a tape roll for supplying a tape, a guide means for guiding the tape, and a feed roller for feeding the tape from the tape roll; wherein, when the tape printer case is engaged with the portable printer, the printing portion of the printing head faces the tape guided by the guide means while the drive wheel is operatively connected to the feed roller for rotationally driving the feed roller.

With the arrangement described above, when the portable printer is removed from the tape printer case, the portable printer can run on a desk top for example to print information onto a relatively wide paper sheet. Further, when the portable printer is combined with the tape printer case, the rotational drive for the drive wheel is transmitted to the feed roller for feeding the tape from the tape roll, and the printing head of the portable printer is used to print information onto the tape which is supported by the guide means. Thus, there is no need to provide a separate drive source and a separate printing head in the tape printer case itself.

Preferably, the tape printer case further accommodates a roll of transparent or semitransparent adhesive tape and a pair of pressing rollers, and the adhesive tape is passed between the pair of pressing rollers together with the first-mentioned tape. In this case, one of the pressing rollers may be operatively connected to the feed roller for synchronous rotation therewith, so that the drive of the single motor is also utilized for feeding the adhesive tape.

According to a preferred embodiment of the present invention, the tape printer case includes a removable cartridge which accommodates the tape roll, the guide means and the feed roller. In this case, the tape printer case as a whole need not be replaced.

Other objects, features and advantages of the present invention will become apparent from the following detailed description of the preferred embodiments given with reference to the accompanying drawings.

DETAILED DESCRIPTION OF THE PREFERRED EMBODIMENT

Figure 1:
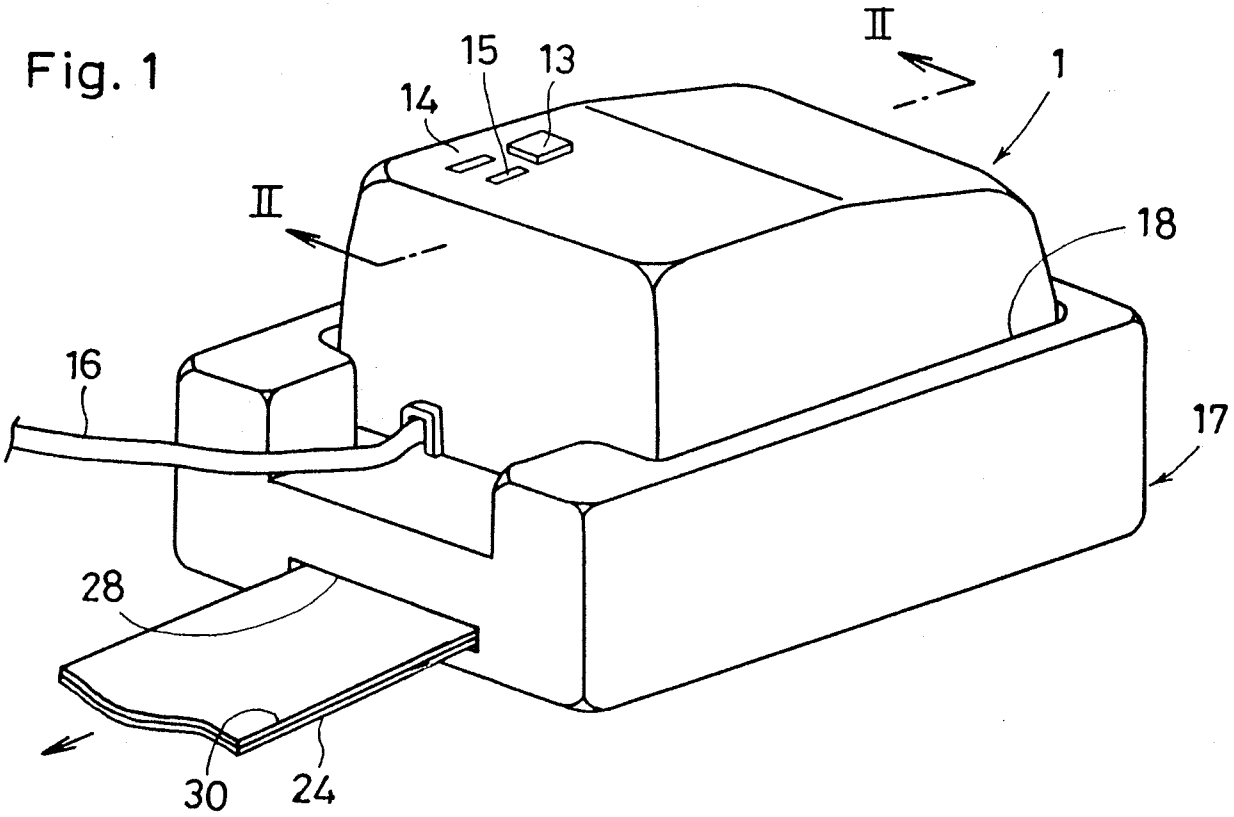
FIG. 1 is a perspective view showing a composite printing device embodying the present invention in its assembled state.

Referring now to the accompanying drawings, a composite printing device according to the present invention incorporates a portable printer 1 and a tape printer case 17. The portable printer 1 is usable alone when separated from the tape printer case 17. On the other hand, the composite printing device as a whole is usable as a tape printer when the portable printer 1 is operatively combined with the tape printer case 17, as shown in FIG. 1.

Figure 2:
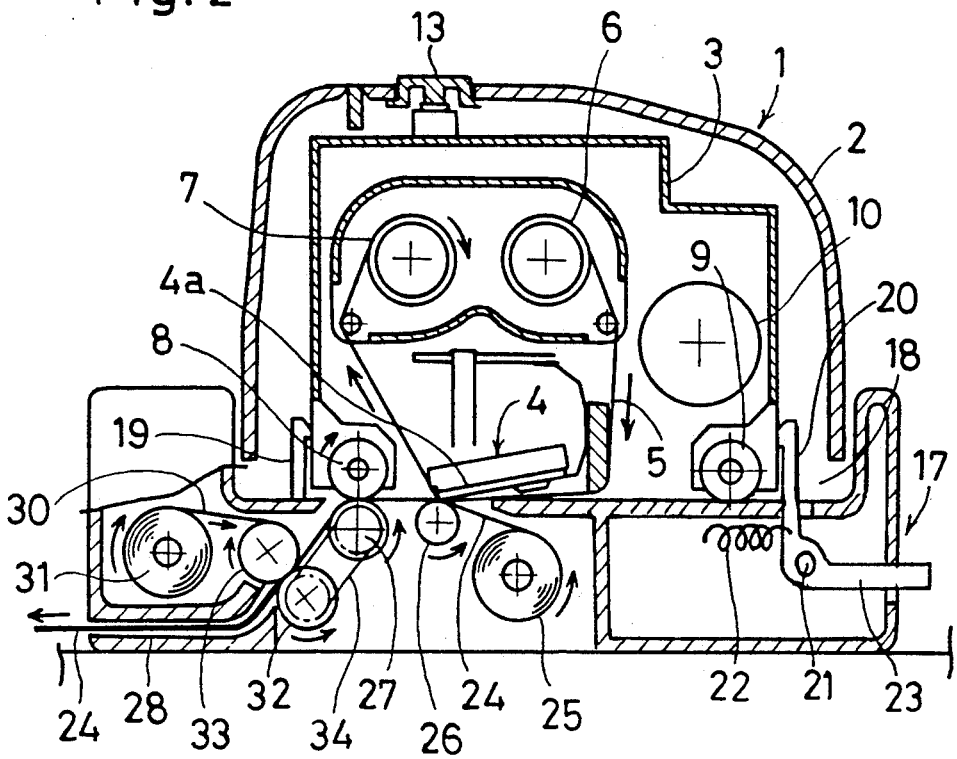
FIG. 2 is a sectional view taken along lines II—II in FIG. 1.
Figure 3:
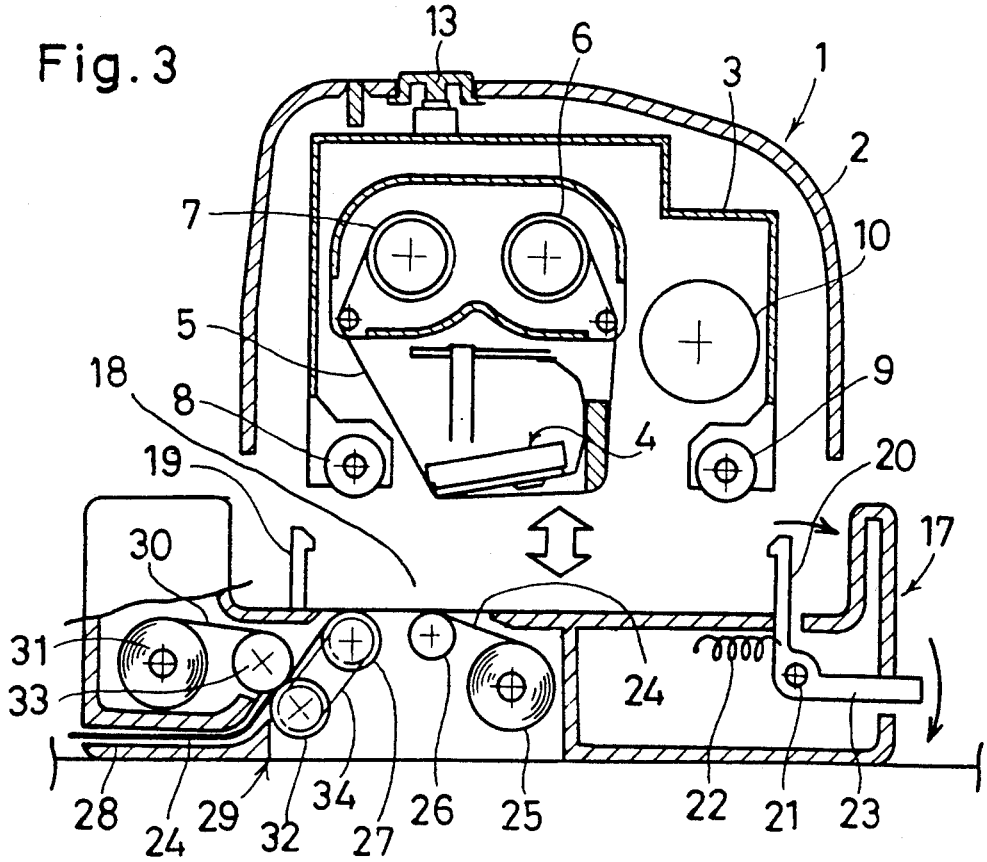
FIG. 3 is a sectional view similar to FIG. 2 but showing the same printing device in its disassembled state.

As shown in FIGS. 2 and 3, the portable printer 1 includes a resinous case 2 (portable printer case) and a chassis 3 mounted in the case 2. The chassis 3 supports a thermal head 4 having a downwardly directed heating portion 4*a*. The chassis 3 also supports a supply reel 6 and a winding reel 7, so that an ink ribbon 5 fed from the supply reel 6 passes immediately under the thermal head 4 to be wound up on the winding reel 7. Obviously, the thermal head 4 is only one example and may be replaced by a different printing head such as a dot printing head.

The chassis 3 is provided, at its bottom, with a pair of drive wheels 8 and a pair of idle wheels 9. The drive wheels 8 are driven into rotation by a motor 10 through a reduction gear train 11 (FIG. 7) and a belt 12 (also FIG. 7). Thus, the portable printer 1 is capable of running automatically at a predetermined speed. The motor 10, gear train 11 and belt 12 are all housed in the chassis 3.

The motor 10 also drives the winding reel 7 through an unillustrated reduction mechanism, so that the ink ribbon 5 is automatically fed from the supply reel 6. The reduction ratio provided by the unillustrated reduction mechanism is such that the feed speed of the ink ribbon 5 becomes equal to the running speed of the portable printer 1.

As shown in FIG. 1, the portable printer case 2 has a top portion provided with a starter switch 13 and LED indicators 14, 15. The indicators 14, 15 are provided for notifying the printing condition and etc. The portable printer 1 is connected to an external controller (not shown) through a signal cable 16 and operates in response to signals from the controller.

The tape printer case 17 has an upwardly open recess 18 for removably receiving the portable printer 1. The recess 18 is provided with a pair of stationary latches 19 and a pair of pivotal latches 20. Both pairs of latches 19, 20 are directed upward for engagement with the chassis 3 of the portable printer 1 when the latter is fitted into the recess 18.

As shown in FIG. 3, each of the pivotal latches 20 forms part of a lever 23 which pivots about a shaft 21 and is always biased in a latching direction by a spring 22. Thus, the portable printer 1 is removable from the tape printer case 17 simply by operating the lever 23.

The tape printer case 17 accommodates a tape roll 25 for supplying a tape 24, a platen 26 for guiding the tape 24 toward the thermal head 4, and a feed roller 27 for transferring the tape 24 through a discharge path 28. When the portable printer 1 is fitted in the recess 18 of the tape printer case 17 (see FIG. 2), the platen 26 forces the tape 24 against the heating portion 4*a* of the thermal head 4, whereas the feed roller 27 comes into driving contact with the drive wheels 8 (see also FIG. 2).

Preferably, the tape printer case 17 further accommodates roll 31 of a transparent or semitransparent adhesive tape 30 and a pair of pressing rollers 32, 33, as shown in FIGS. 2 and 3. One pressing roller 32 is connected to the feed roller 27 by a belt 34, so that the driving rotation of the feed roller 27 is also transmitted to the pressing roller 32. Thus, the adhesive tape 30 guided by the other pressing roller 33 is fed between the respective pressing rollers 32, 33 together with the tape 24 for discharge through the discharge passage 28.

Figure 5:
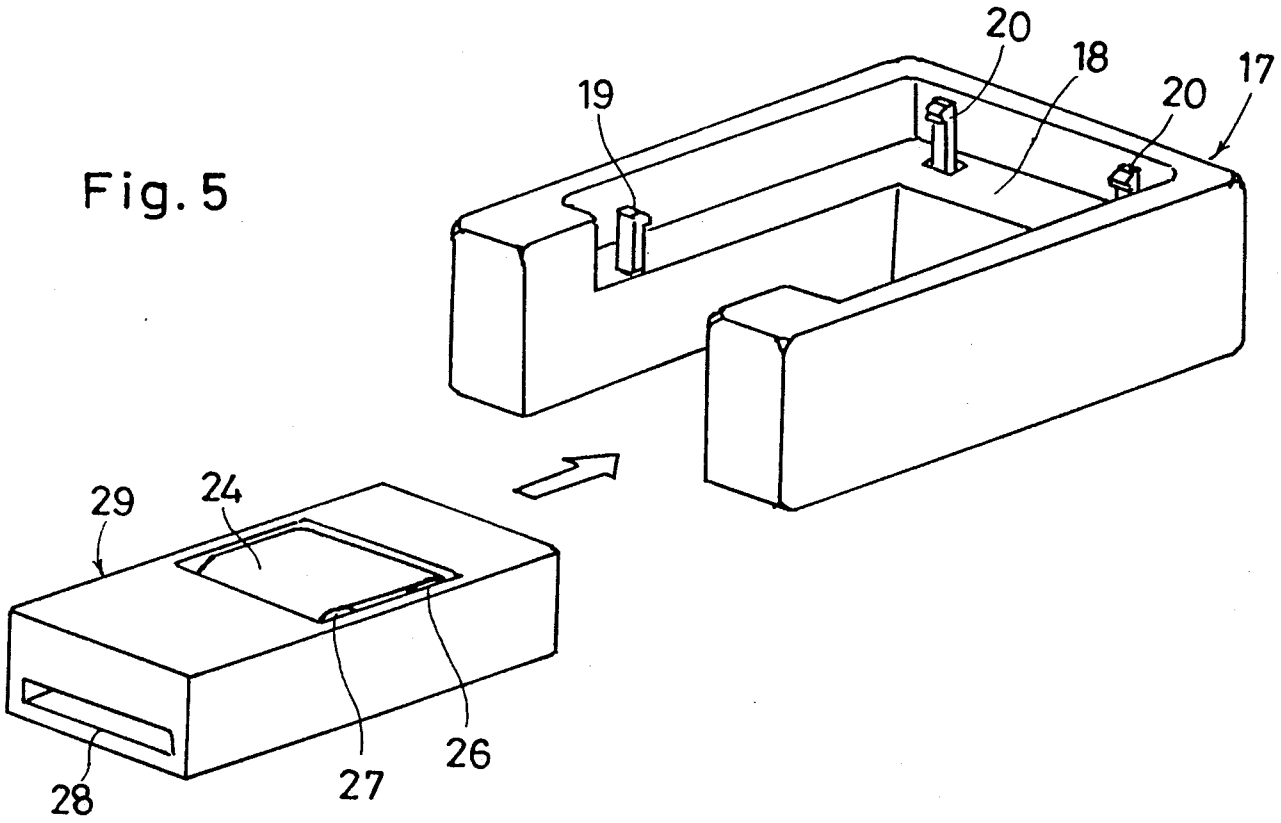
FIG. 5 is a perspective view showing a slightly modified tape printer case.

Advantageously, the tape printer case 17 may be made to include a separable cartridge 29, as shown in FIG. 5. In this case, the tape roll 25, platen 26, feed roller 27, adhesive tape roll 31, pressing rollers 32, 33 and belt 34 are accommodated together within the cartridge 29.

In use as a tape printer, the portable printer 1 is fitted into the recess 18 of the tape printer case 17, as shown in FIG. 2. In this condition, the tape 24 is forced against the heating portion 4*a* of the thermal head 4, and the feed roller 27 comes into driving contact with the drive wheels 8. As a result, the rotational drive force transmitted from the motor 10 to the drive wheels 8 is utilized to drive the feed roller 27 for feeding the tape 24 from the tape roll 25, and the intended printing can be performed automatically onto the tape 24 by utilizing the thermal head 4 of the portable printer 1. Thus, no separate drive source and printing head need be provided in the tape printer case 17 itself.

Further, according to the illustrated embodiment, one pressing roller 32 is also driven rotationally by the feed roller 27 (namely, the motor 10). Thus, the adhesive tape 30 can be fed out automatically and synchronously together with the tape 24 for coating the printed information on the tape 24 without providing a separate feed drive for the adhesive tape.

Figure 4:
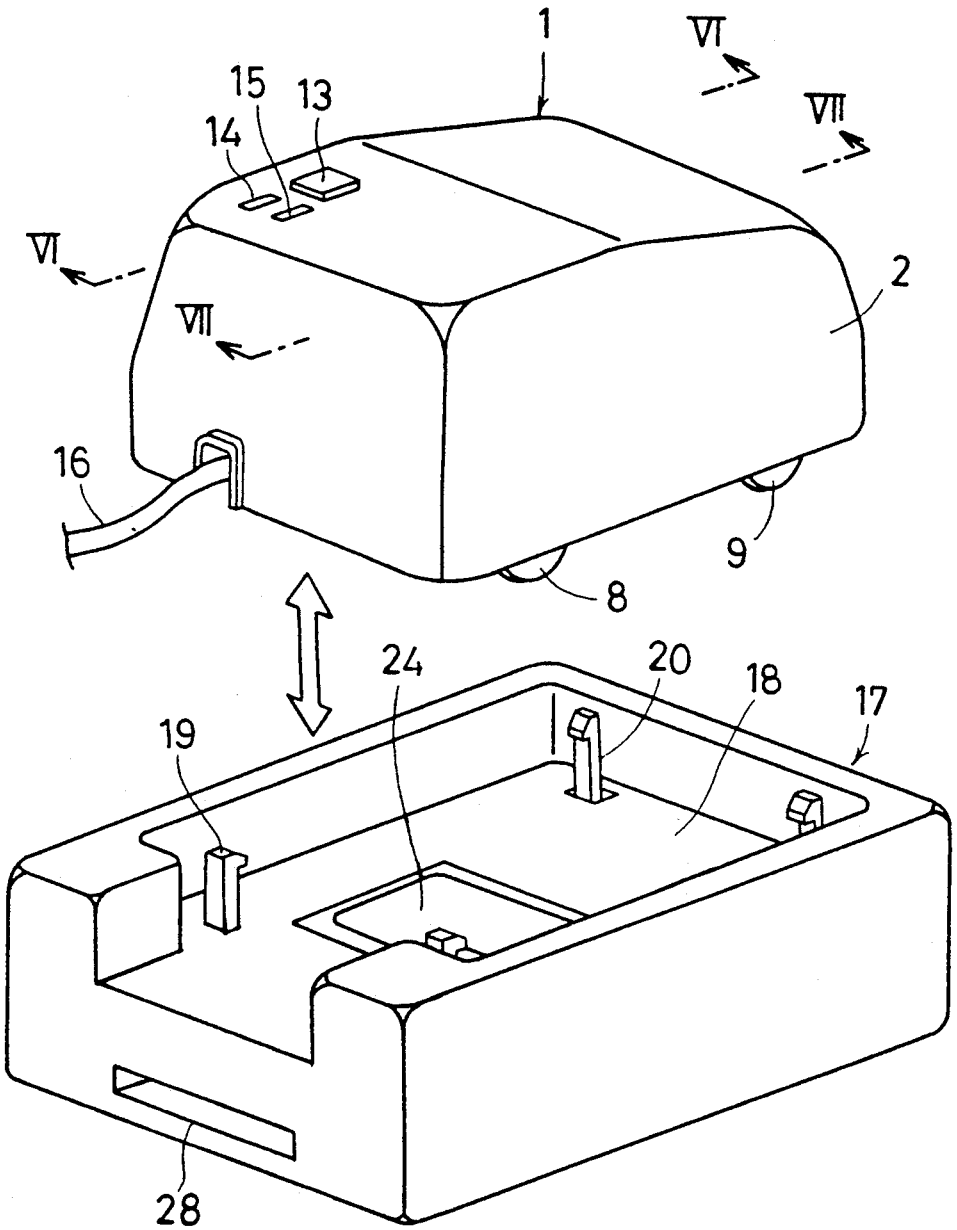
FIG. 4 is a perspective view showing the same printing device in its disassembled state.
Figure 4:
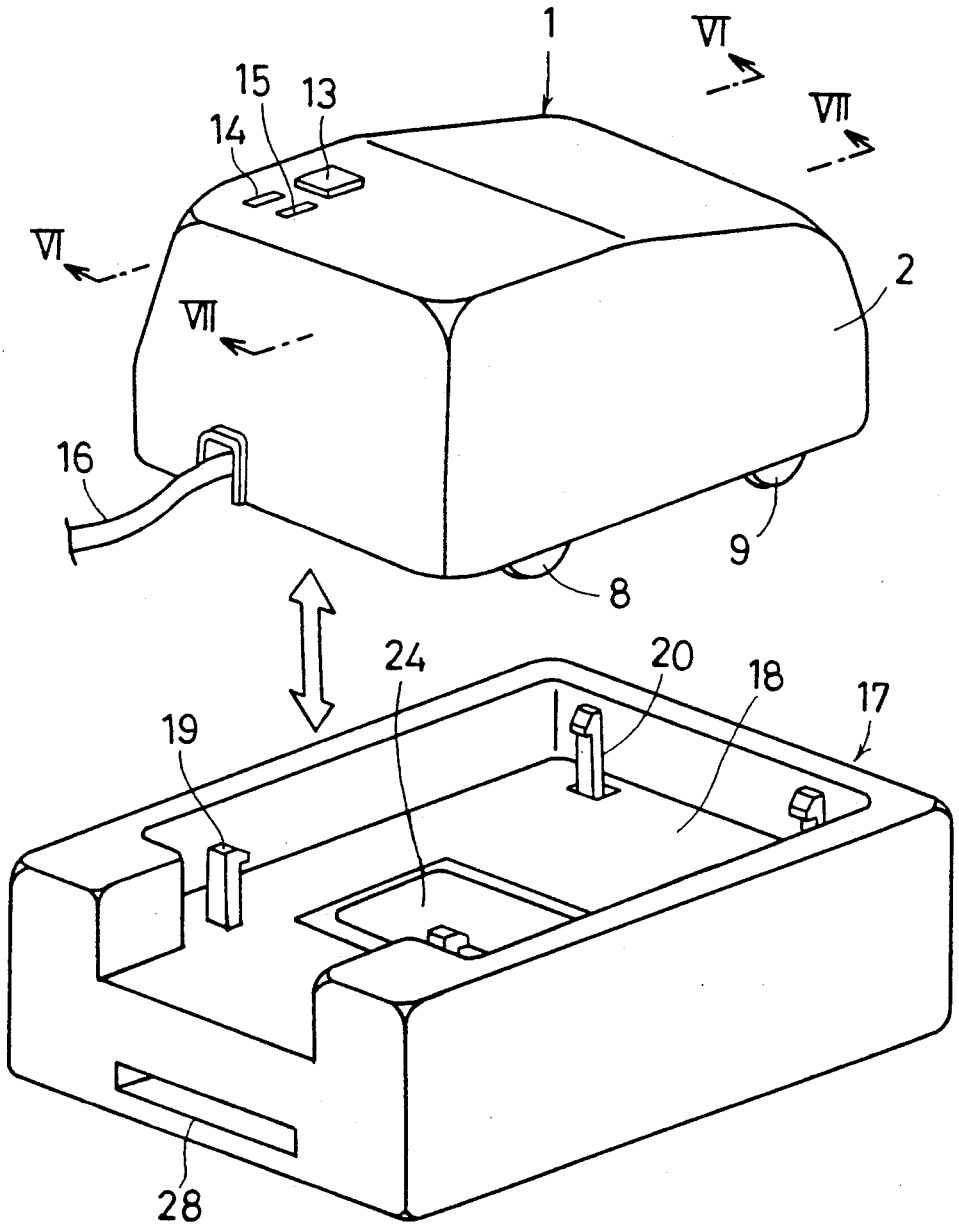
Figure 6:
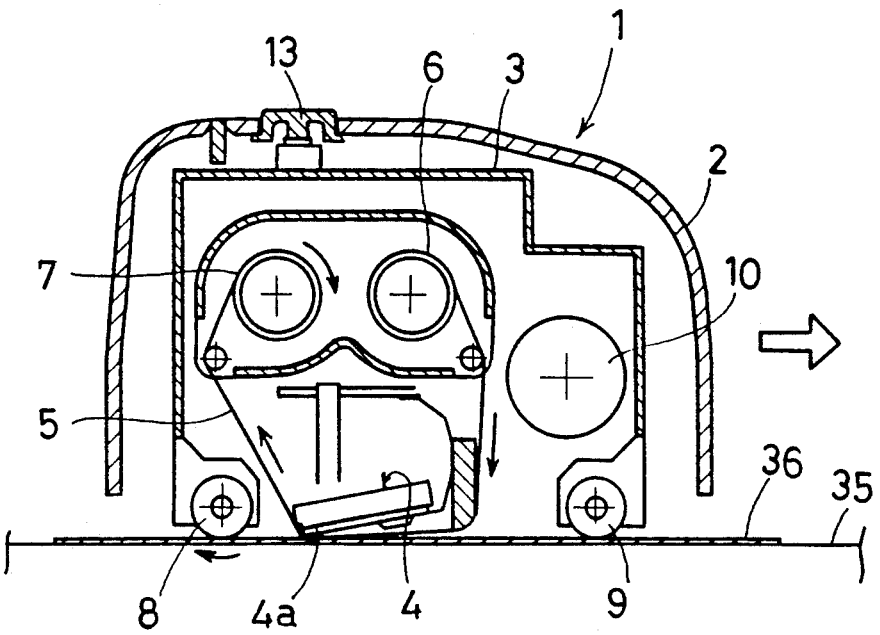
FIG. 6 is a sectional view taken along lines VI—VI in FIG. 4.
Figure 7:
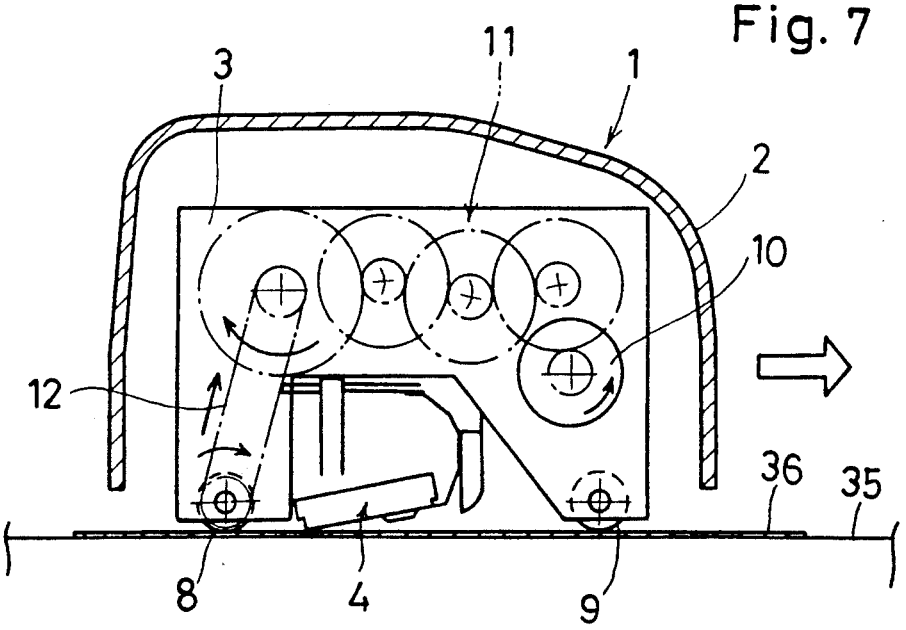
FIG. 7 is a sectional view taken along lines VII—VII in FIG. 4.

On the other hand, the portable printer 1 may be removed from the tape printer case 17, as shown in FIGS. 3 and 4. In this condition, the printer 1 may be made to run automatically on a desk top 35 for example to perform printing on a wider paper sheet 36, as shown in FIGS. 6 and 7.

The present invention being thus described, it is obvious that the same may be varied in many ways. For instance, the portable printer 1 need not incorporate the ink ribbon 5 if the thermal head 4 is made to print information on a sheet or tape of thermosensitive paper. Such variations are not to be regarded as a departure from the spirit and scope of the invention, and all such modifications as would be obvious to those skilled in the art are intended to be included within the scope of the following claims.

We claim:

1. A composite printing device for printing either on a tape or on a flat surface comprising:

a tape printer case including therein a tape roll for supplying a tape, a guide means for guiding the tape, and a feed roller for feeding the tape from the tape roll and means for receiving a portable printer; and the portable printer including a printing head having a downwardly facing printing portion, a plurality of wheels for supporting the portable printer, the wheels including at least one drive wheel, and a motor always held in driving connection with the drive wheel, the motor comprising means for rotationally driving the drive wheel to propel the printer across a flat surface when the printer has been removed from the printer case;

wherein the composite printing device further comprises means for removably engaging the tape printer case with the portable printer from below to bring the printing portion of the printing head to a position racing the tape guided by the guide means and to connect operatively the drive wheel to the feed roller for driving the feed roller rotationally.

2. The composite printing device according to claim 1, wherein the drive wheel is made to abut the feed roller when the portable printer is engaged with the tape printer case.

3. The composite printing device according to claim 1, wherein the tape printer case has an upwardly open recess for removably receiving the portable printer.

4. The composite printing device according to claim 1, wherein the tape printer case is provided with upwardly directed latches for removably engaging the portable printer.

5. The composite printing device according to claim 4, wherein at least one of the latches forms a part of a pivotal lever which is always spring-biased in a latching direction.

6. The composite printing device according to claim 1, wherein the tape printer case further comprises a roll of transparent or semitransparent adhesive tape and a pair of pressing rollers, the adhesive tape being passed between the pair of pressing rollers together with the first-mentioned tape, one of the pressing rollers being operatively connected to the feed roller for synchronous rotation therewith.

7. The composite printing device according to claim 1, wherein the tape printer case includes a removable cartridge which accommodates the tape roll, the guide means and the feed roller.

8. The composite printing device according to claim 6, wherein the tape printer case includes a removable cartridge which accommodates the tape roll, the guide means, the feed roller, the adhesive tape roll, and the pressing rollers.

9. The composite printing device according to claim 1, wherein the printing head is a thermal head.

10. The composite printing device according to claim 1, wherein the guide means is a platen.

* * * * *